US011186936B2

(12) United States Patent
Park et al.

(10) Patent No.: US 11,186,936 B2
(45) Date of Patent: Nov. 30, 2021

(54) DETERGENT SUPPLY DEVICE AND WASHING MACHINE INCLUDING SAME

(71) Applicant: SAMSUNG ELECTRONICS CO., LTD., Suwon-si (KR)

(72) Inventors: Jun-hong Park, Yongin-si (KR); Do-yeon Kim, Yongin-si (KR); Jong-ha Park, Suwon-si (KR); Eung-ryeol Seo, Suwon-si (KR); Geon-ung Lee, Hwaseong-si (KR); Hong-yeol Lee, Yongin-si (KR); Woong Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 259 days.

(21) Appl. No.: 16/325,931

(22) PCT Filed: Aug. 9, 2017

(86) PCT No.: PCT/KR2017/008585
§ 371 (c)(1),
(2) Date: Feb. 15, 2019

(87) PCT Pub. No.: WO2018/034456
PCT Pub. Date: Feb. 22, 2018

(65) Prior Publication Data

US 2019/0203404 A1 Jul. 4, 2019

(30) Foreign Application Priority Data

Aug. 19, 2016 (KR) ..... 10-2016-0105682

(51) Int. Cl.
*D06F 33/48* (2020.01)
*D06F 39/02* (2006.01)
(Continued)

(52) U.S. Cl.
CPC ..... *D06F 33/48* (2020.02); *D06F 39/02* (2013.01); *D06F 39/022* (2013.01);
(Continued)

(58) Field of Classification Search
CPC ..... D06F 37/22; D06F 39/02; D06F 39/022; D06F 39/028; D06F 39/08; D06F 39/088; D06F 33/48
See application file for complete search history.

(56) References Cited

U.S. PATENT DOCUMENTS 7,805,964 B2 10/2010 Park
7,934,403 B2 5/2011 Cho et al.
(Continued)

FOREIGN PATENT DOCUMENTS

CN 1712622 12/2005
CN 1890422 1/2007
(Continued)

OTHER PUBLICATIONS

International Search Report dated Nov. 7, 2017 in corresponding International Application No. PCT/KR2017/008585, 4 pages.
(Continued)

*Primary Examiner* — Joseph L. Perrin
(74) *Attorney, Agent, or Firm* — Staas & Halsey, LLP

(57) ABSTRACT

Disclosed is a washing machine having an improved structure so as to enable noise reduction. The disclosed washing machine comprises: a main body; a drum rotatably disposed inside the main body; and a detergent supply device provided in the main body and supplying detergent into the drum, wherein the detergent supply device includes: a housing; a detergent container containing the detergent and movably coupled to the housing; and a water supply frame having an inflow hole through which water supplied from the outside flows in, and a flow velocity mitigation part
(Continued)

provided at the lower side of the inflow hole so as to mitigate the flow velocity of the water.

14 Claims, 11 Drawing Sheets

(51) Int. Cl.
*D06F 39/08* (2006.01)
*D06F 37/06* (2006.01)

(52) U.S. Cl.
CPC ..... *D06F 39/028* (2013.01); *D06F 39/088* (2013.01); *D06F 37/06* (2013.01); *D06F 39/08* (2013.01)

(56) References Cited

U.S. PATENT DOCUMENTS

| | | | | |
|---|---|---|---|---|
| 7,942,024 | B2 | 5/2011 | Lee | |
| 2005/0229645 | A1 | 10/2005 | Kim et al. | |
| 2005/0274156 | A1* | 12/2005 | Yang | D06F 39/028 68/17 R |
| 2007/0125134 | A1 | 6/2007 | Park | |
| 2007/0271967 | A1 | 11/2007 | Lee | |
| 2011/0247147 | A1* | 10/2011 | Amos | D06F 39/028 8/137 |
| 2011/0277515 | A1* | 11/2011 | Doh | D06F 39/02 68/17 R |
| 2012/0060568 | A1* | 3/2012 | Buso | D06F 39/088 68/17 R |
| 2014/0157836 | A1* | 6/2014 | Zattin | D06F 39/028 68/17 R |
| 2017/0350060 | A1* | 12/2017 | Favaro | D06F 39/028 |

FOREIGN PATENT DOCUMENTS

| | | | |
|---|---|---|---|
| CN | 201058940 | | 5/2008 |
| CN | 101880951 | | 11/2010 |
| CN | 102449228 | A | 5/2012 |
| CN | 103069068 | | 4/2013 |
| EP | 2345759 | | 3/2014 |
| EP | 2653601 | | 2/2016 |
| JP | 4-279192 | | 10/1992 |
| JP | 9-117590 | | 5/1997 |
| JP | 2008-113977 | | 5/2008 |
| JP | 2012-170690 | | 9/2012 |
| KR | 10-0721836 | | 5/2007 |
| KR | 10-0730921 | | 6/2007 |
| KR | 10-2008-0087363 | | 10/2008 |
| KR | 10-1082564 | | 11/2011 |
| KR | 10-1183151 | | 9/2012 |
| KR | 10-1186320 | | 9/2012 |
| KR | 10-1454657 | | 10/2014 |
| WO | 2005/056908 | | 6/2005 |
| WO | 2010/115622 | A1 | 10/2010 |

OTHER PUBLICATIONS

Written Opinion of the International Searching Authority dated Nov. 7, 2017 in corresponding International Application No. PCT/KR2017/008585, 7 pages.

Chinese Office Action dated Sep. 27, 2020 from Chinese Application No. 201780050756.9, 21 pages.

Chinese Office Action dated May 26, 2021 from Chinese Application No. 201780050756.9.

* cited by examiner

FIG. 9

| Housing Drawer(M) | WATER SUPPLY | |
|---|---|---|
| | SOUND PRESSURE(SPL) [dB(A)] | Loudness |
| RELATED ART | 46.7 | 5.0 |
| EXEMPLARY EMBODIMENT | 40.1 ( 6.6 ▼ ) | 3.6 ( 1.4 ▼ ) |
| ANOTHER EXEMPLARY EMBODIMENT | 40.6 ( 6.1 ▼ ) | 3.6 ( 1.4 ▼ ) |
| REMARKS | SOUND PRESSURE: FRONT SURFACE 1.0 m / HEIGHT 1.5 m | |

DETERGENT SUPPLY DEVICE AND WASHING MACHINE INCLUDING SAME

CROSS-REFERENCE TO RELATED APPLICATIONS

This application is a National Phase application, under 35 U.S.C. § 371, of International Application No. PCT/KR2017/008585 filed Aug. 9, 2017, which claims Convention Priority to Korean patent application No. 10-2016-0105682 filed Aug. 19, 2016, the entire disclosures of which are herein incorporated by reference as a part of this application.

TECHNICAL FIELD

Apparatuses consistent with the disclosure relate to a detergent supply device having an improved structure capable of reducing a noise and a washing machine including the same.

BACKGROUND ART

In general, a washing machine is a machine that washes laundry using electric power, and includes a tub storing washing water, a drum rotatably installed in the tub, a pulsator rotatably installed on a bottom of the drum, and a motor rotating the drum and the pulsator.

A washing machine includes a water supply unit supplied with water from an external water source and transferring the water in the washing machine, a detergent supply device supplying a detergent to the supplied water from the water supply unit, and a connection pipe transferring the water with the dissolved detergent to a washing tub again.

In addition, the detergent supply device includes a detergent container partitioned to separately receive and contain different types of detergents such as a detergent, a fabric softener, and a bleaching agent depending on a washing step, and channels for distributing the water to each section of the detergent container so that a detergent required for each washing step may be supplied. A water supply pipe supplying cold water or hot water is connected to the channels. The water supply pipe is installed in a fixed direction, such that the water to be sprayed from the water supply pipe flows through an appropriate channel.

Since the water introduced from the water supply pipe is sprayed into the channel at a relative high speed, an internal pressure of the channel is reduced. As a result, when the introduced air through the channel and air remaining in the channel is mixed with the sprayed water, the air exists in a bubble form and a flow is generated by a structure of the channel, thus a low-frequency cavitation noise is generated. This phenomenon causes a problem in that the higher the flow rate, the more the phenomenon is accelerated, resulting in the greater noise.

DISCLOSURE

Technical Problem

An object of the disclosure is to provide a detergent supply device capable of significantly reducing a noise generated by bubbles which are generated when the introduced air and air remaining in the channel is mixed with the sprayed water during a water supply process of a washing machine and a washing machine including the same.

Technical Solution

The disclosure provides a detergent supply device capable of significantly reducing a noise generated during a water supply process of a washing machine and a washing machine including the same.

The disclosure also provides a detergent supply device capable of having improved reliability by uniformly supplying water supplied to the detergent supply device to a detergent container to maintain washing performance, and a washing machine including the same.

According to an aspect of the disclosure, a washing machine includes: a main body; a drum configured to be rotatably disposed in the main body; and a detergent supply device configured to be provided in the main body and supply a detergent into the drum, wherein the detergent supply device includes a housing, a detergent container configured to contain the detergent and be movably coupled to the housing, and a water supply frame configured to include an inflow hole into which water supplied from the outside is introduced, and a flow velocity reducer provided on a downstream side of the inflow hole and reducing a flow velocity of the water.

According to another aspect of the disclosure, a detergent supply device includes: a housing configured to have an opening formed in one side thereof; a detergent container configured to contain a detergent and be slidably coupled to the housing through the opening; and a water supply frame configured to be coupled to the housing and include a channel guiding water to the detergent container, an inflow hole into which water supplied from the outside is introduced, and a flow velocity reducer provided on a downstream side of the inflow hole and reducing a flow velocity of the water.

DESCRIPTION OF DRAWINGS

FIG. 9 is a table illustrating the result of a comparison between a noise of a detergent supply device of the related art and a noise of a detergent supply device according to an exemplary embodiment of the disclosure.

BEST MODE

Figure 1:
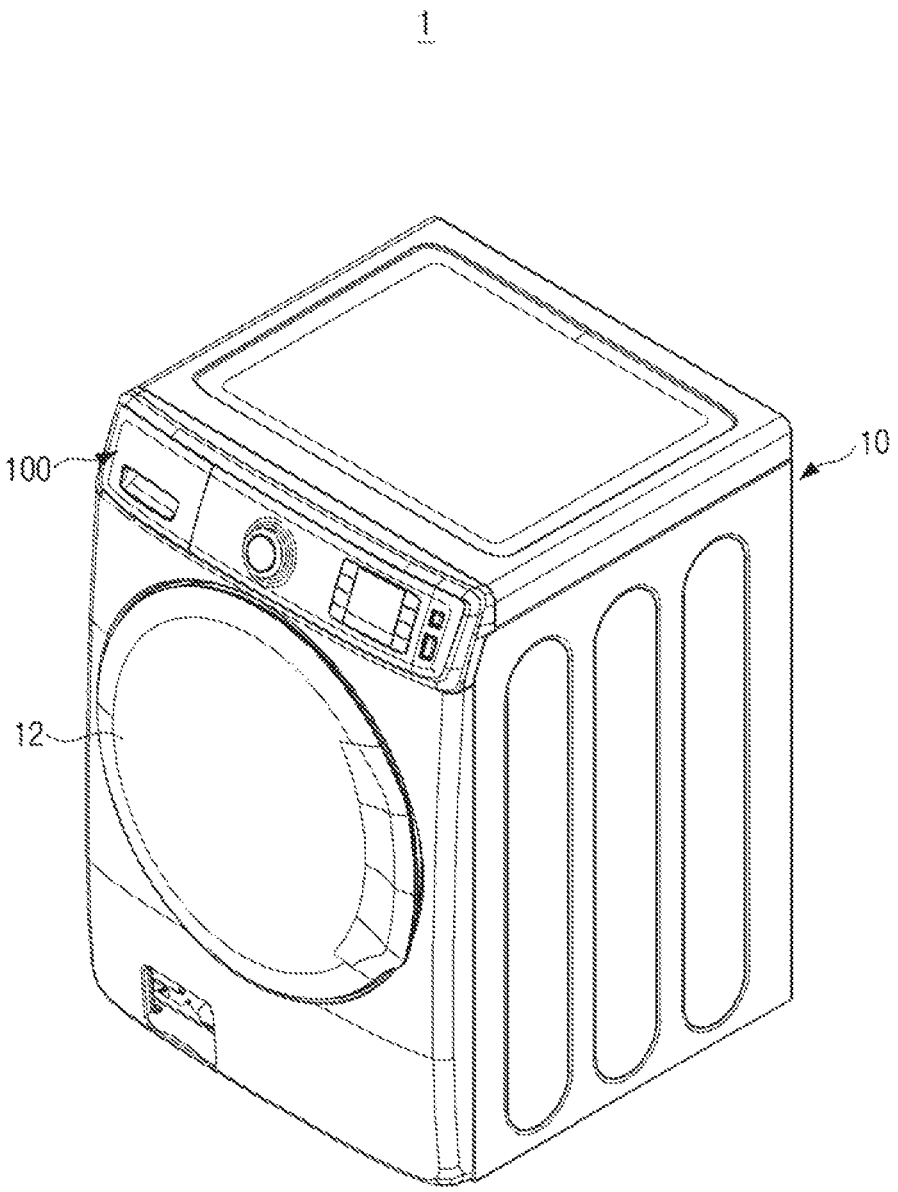
FIG. 1 is a perspective view illustrating an appearance of a washing machine according to an exemplary embodiment of the disclosure.

Hereinafter, an exemplary embodiment of the disclosure will be described in detail with reference to FIGS. 1 to 11. Exemplary embodiments to be described below will be described on the basis of exemplary embodiments most appropriate for understanding technical features of the disclosure, and these exemplary embodiments do not limit the technical features of the disclosure, but exemplify that the disclosure may be implemented like these exemplary embodiments.

Therefore, the disclosure may be variously modified without departing from the technical scope of the disclosure through exemplary embodiments to be described below, and these modifications will be to fall within the technical scope of the disclosure. In addition, to assist in the understanding of exemplary embodiments to be described below, components performing the same operations and related components in the respective exemplary embodiments will be denoted by the same or similar reference numerals throughout the accompanying drawings.

Figure 2:
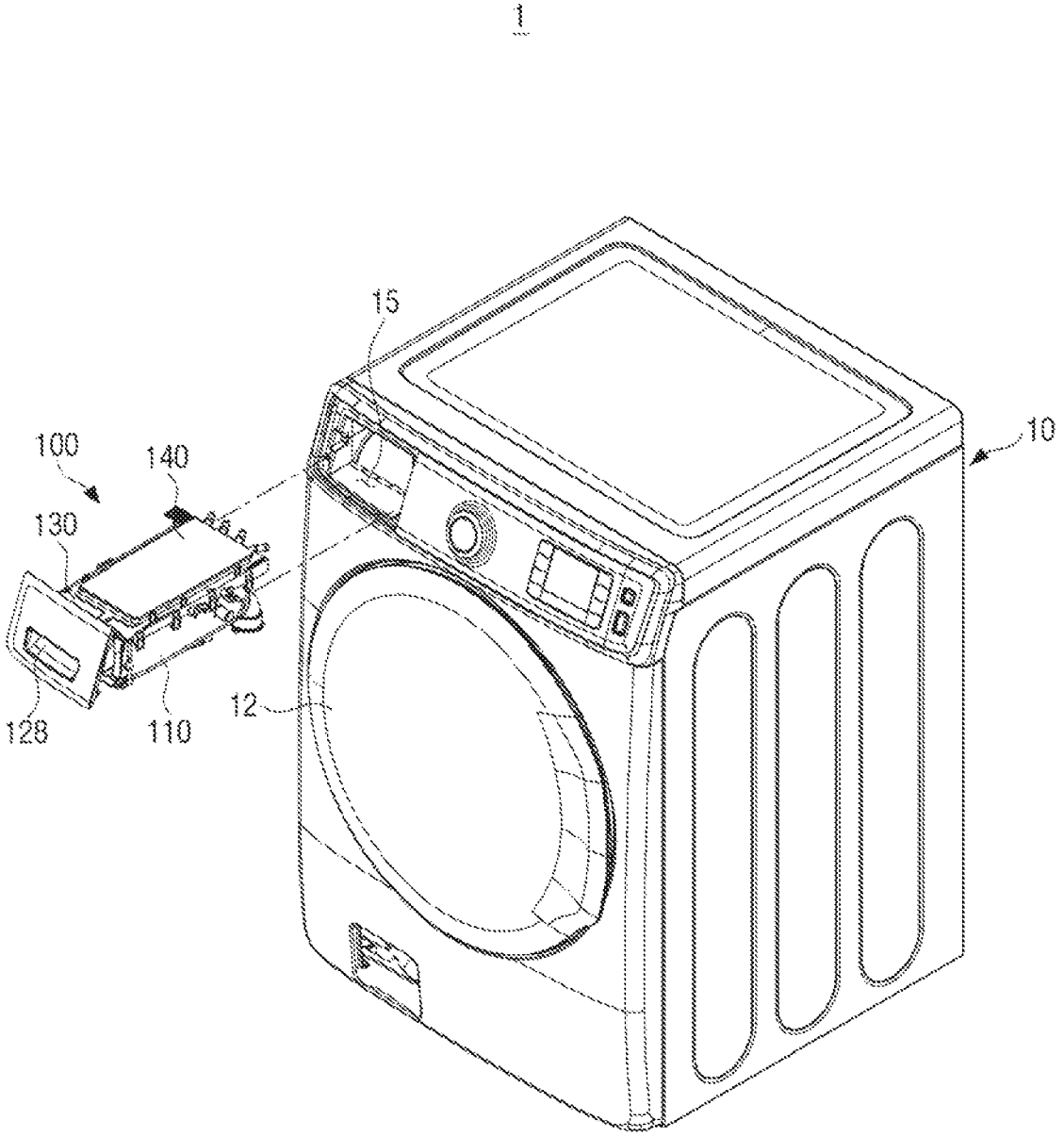
FIG. 2 is a cross-sectional view of a washing machine according to an exemplary embodiment of the disclosure.
Figure 3:
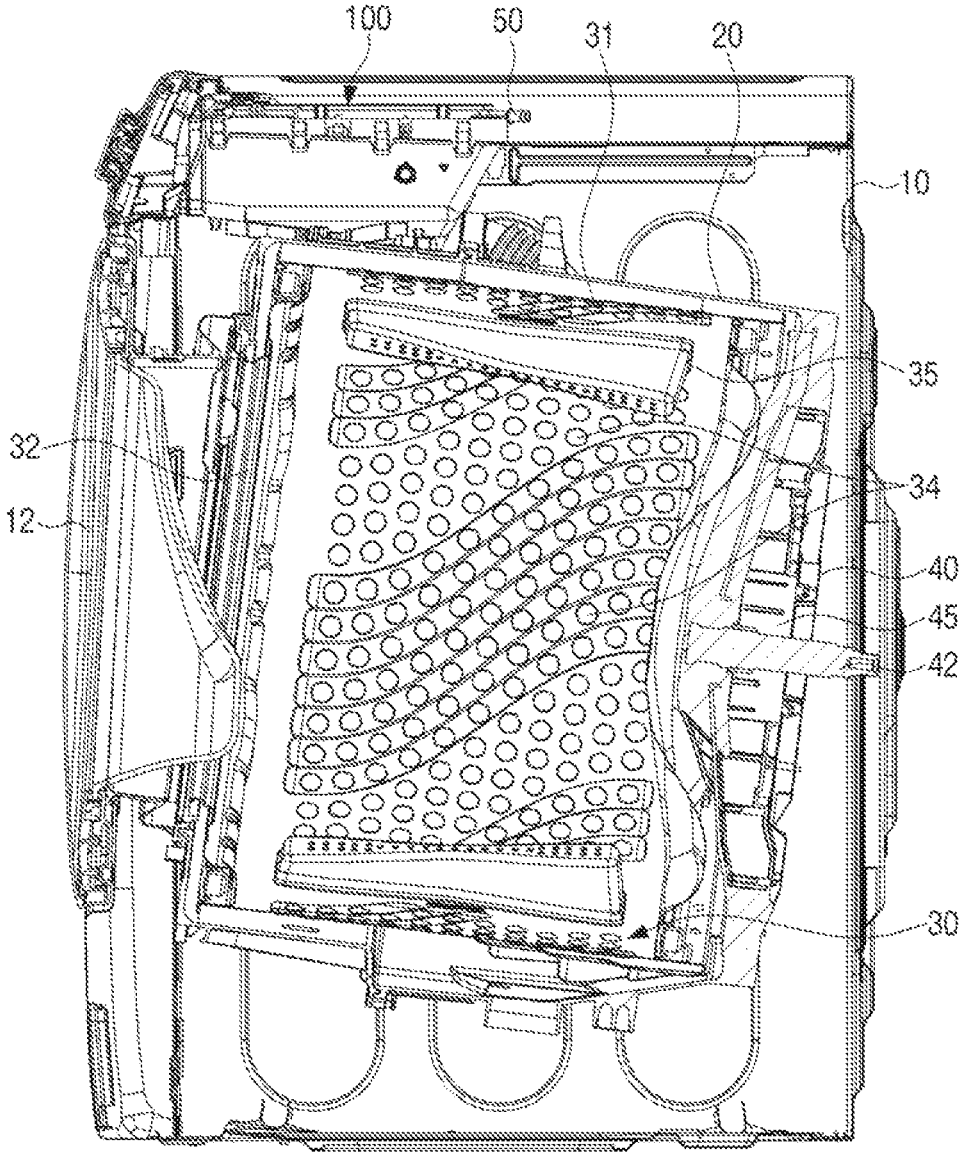
FIG. 3 is an enlarged cross-sectional view of a detergent supply device according to an exemplary embodiment of the disclosure.
Figure 4:
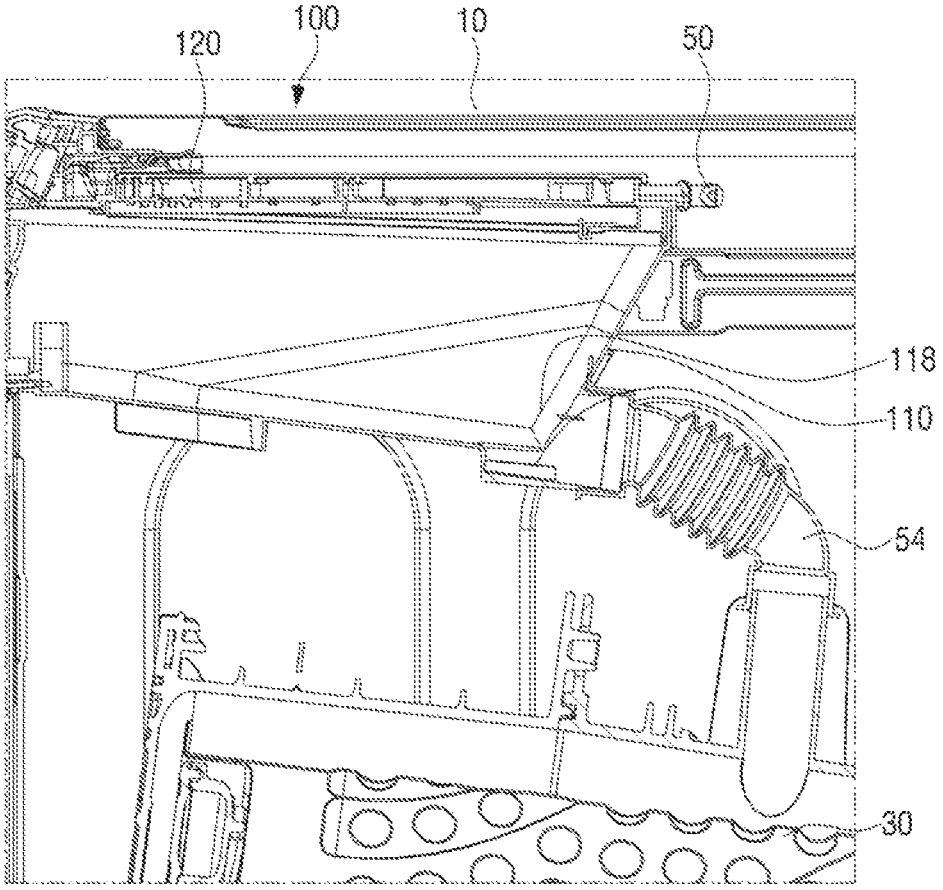
FIG. 4 is an exploded perspective view illustrating a detergent supply device according to an exemplary embodiment of the disclosure.

FIG. 1 is a perspective view illustrating an appearance of a washing machine according to an exemplary embodiment of the disclosure, and FIG. 2 is a cross-sectional view of a washing machine according to an exemplary embodiment of the disclosure. In addition, FIG. 3 is an enlarged cross-sectional view of a detergent supply device according to an exemplary embodiment of the disclosure, and FIG. 4 is an exploded perspective view illustrating a detergent supply device according to an exemplary embodiment of the disclosure.

Referring to FIGS. 1 to 4, as illustrated in FIG. 1, a washing machine 1 includes a main body 10 forming an external appearance of the washing machine and supporting various components mounted therein, a tub 20 disposed in the main body 10, a drum 30 rotatably disposed in the tub 20, and a motor 40 driving the drum 30.

The main body 10 is formed with an inlet 11 in a front surface portion thereof, such that laundry may be injected into the drum 30 through the inlet 11. The inlet 11 is opened and closed by a door 12 installed in the front surface portion of the main body 10.

A water supply pipe 50 for supplying washing water to the tub 20 is installed above the tub 20. One end of the water supply pipe 50 is connected to an external water supply source (not illustrated) and the other end of the water supply pipe 50 is connected to a detergent supply device 100.

The detergent supply device 100 is connected to the tub 20 through a connection pipe 54 and includes a detergent container 120 containing a detergent and a fabric softener. Water supplied through the water supply pipe 50 is supplied into the tub 20 together with the water with the detergent or the fabric softener, by passing through the detergent container 120. The detergent supply device 100 may be inserted into an installation port 15 provided in the main body and be coupled to the installation port 15.

A water draining pump (not illustrated) and a water draining pipe (not illustrated) discharging the water of the tub 20 to the outside of the main body 10 may be installed at a lower portion of the tub 20.

The tub 20 is supported by a damper 80. The damper 80 connects an inner bottom surface of the main body 10 and an outer surface of the tub 20 to each other.

The drum 30 may include a cylindrical body 31, a front plate disposed in front of the cylindrical body 31, and a rear plate disposed behind the cylindrical body 31. An inlet 32*a* through which laundry is placed or removed is formed in the front plate, and a driving shaft 42 transferring a driving force of the motor 40 is connected to the rear plate.

A plurality of through-holes 34 for circulation of washing water are formed along a circumferential portion of the drum 30. A plurality of lifters 35 are installed along an inner circumferential surface of the drum 30 so that laundry may be lifted and dropped when the drum 30 rotates.

The driving shaft 42 is disposed between the drum 30 and the motor 40. One end of the driving shaft 42 is connected to the rear plate of the drum 30 and the other end of the driving shaft 42 extends outwardly of a rear wall of the tub 20. When the driving shaft 42 is driven by the motor 40, the drum 30 connected to the driving shaft 42 rotates around the driving shaft 42.

A bearing housing 45 is installed on the rear wall of the tub 20 so that the driving shaft 42 may be rotatably supported by the bearing housing. The bearing housing 45 may be formed of an aluminum alloy and may be inserted into the rear wall of the tub 20 when the tub 20 is subjected to injection molding. Bearings are installed between the bearing housing 45 and the driving shaft 42 so that the driving shaft 42 may smoothly rotate.

Hereinafter, a structure of the detergent supply device 100 according to an embodiment of the disclosure will be described in detail.

Figure 5:
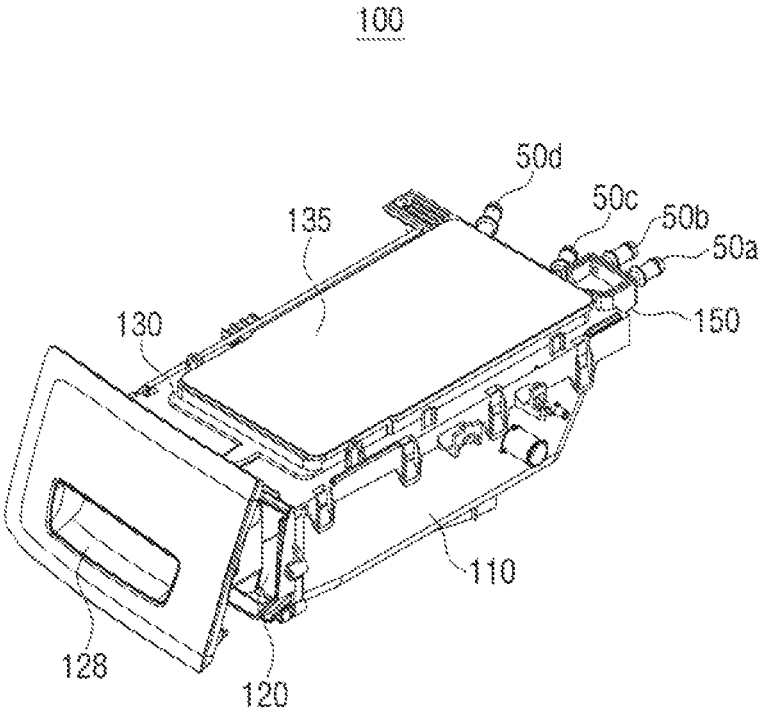
FIG. 5 is a perspective view illustrating a detergent supply device according to an exemplary embodiment of the disclosure.
Figure 6:
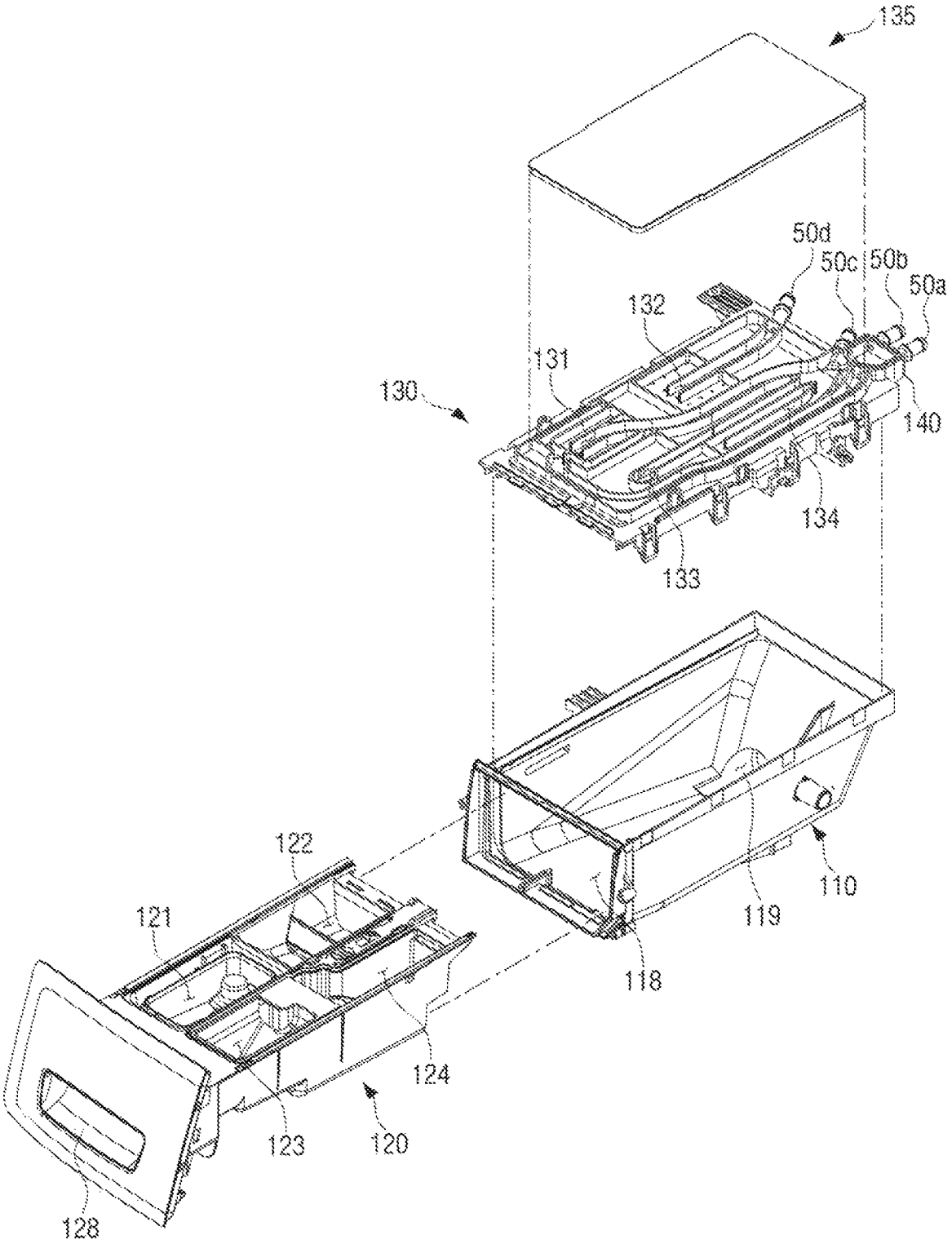
FIG. 6 is an exploded perspective view illustrating a detergent supply device according to an exemplary embodiment of the disclosure.

FIG. 5 is a perspective view illustrating a detergent supply device according to an exemplary embodiment of the disclosure, and FIG. 6 is an exploded perspective view of a detergent supply device according to an exemplary embodiment of the disclosure.

Referring to FIGS. 5 and 6, the detergent supply device 100 according to an exemplary embodiment of the disclosure may be provided on one side of an upper portion of the front surface of the main body 10. The detergent supply device 100 may include a housing 110, a detergent container 120 and a water supply frame 130 coupled to the housing 110, respectively, and a cover frame 135 sealing an upper portion of the water supply frame 130.

An opening 118 may be formed in a front surface of the housing 110 and the detergent container 120 may be inserted into the opening 118 of the housing 110. The detergent container 120 may be slidably drawn from the housing 110. As an example, rails are provided on both inner side surfaces of the housing 110, and the detergent container 120 may thus slidably move in a state where the detergent container 120 is supported by the rails.

A discharge port 119 is provided at a lower portion of the housing 110 so that the detergent (fabric softener and bleaching agent) mixed with water is discharged to the outside of the detergent supply device. The discharge port 119 is connected to the connection pipe 54 and the detergent mixed with water discharged through the discharge port 119 may be supplied to the tub 30 by passing through the connection pipe 54. A bottom surface of the housing 110 may be inclined toward the discharge port 119 so that the detergent mixed with water may be effectively discharged through the discharge port 119, without being accumulated on the lower portion of the housing 110.

The detergent container 120 may contain a main detergent (powder detergent or liquid detergent), a preliminary detergent, a fabric softener, and a bleaching agent. The detergent container 120 may be partitioned into a main detergent storage 121 disposed in a left front portion of the detergent container 120 to store the main detergent, a preliminary detergent storage 122 disposed behind the main detergent storage 121, a fabric softener storage 123 disposed in a right front portion of the detergent container 120, and a bleaching agent storage 124 disposed behind the fabric softener storage 123.

A grip portion 128 may be provided in a front surface of the detergent container 120 so that the detergent container 120 may be pulled out or pushed into the housing 110 by a user.

The water supply frame 130 is disposed above the detergent container 120 and guides the water introduced into the water supply frame 130 to the detergent container 120. As an example, the water supply frame 130 may have sections partitioned into a first section 131 in which water is supplied to the main detergent storage 121, a second section 132 in which water is supplied to the preliminary detergent storage 122, a third section 133 in which water is supplied to the fabric softener storage 123, and a fourth section 134 in which water is supplied to the bleaching agent storage 124.

A plurality of water supply nozzles 50*a*, 50*b*, 50*c*, and 50*d* each may be connected to the water supply frame 130 to be supplied with water from the outside. The water supply nozzles 50*a*, 50*b*, 50*c*, and 50*d* may include the first to fourth water supply nozzles 50*a*, 50*b*, 50*c*, and 50*d*. The first water supply nozzle 50*a* and the second water supply nozzle 50*b* may supply water to the first section 131 through a first channel 150 and a second main channel 161, and the fourth water supply nozzle 50*d* may supply water to the second section 132 through a third channel 170. The third water supply nozzle 50*c* may supply water to the fourth section 134 through a second lower auxiliary channel 167, and the first water supply nozzle 50*a* or the second water supply nozzle 50*b* and the third water supply nozzle 50*c* may supply water to the third section 133 through a second upper auxiliary channel 166. In a case where water is simultaneously sprayed through the first water supply nozzle 50*a* or the second water supply nozzle 50*b* and the third water supply nozzle 50*c*, the water may be supplied to the third section 133.

A plurality of spray holes 150*a* and 161*a*, 166*a*, 167*a*, and 170*a* may be formed in the first to fourth sections 131, 132, 133, and 134, respectively. That is, the water supplied to the water supply frame 130 may drop into the detergent container 120 through the respective spray holes 150*a*, 161*a*, 166*a*, 167*a*, and 170*a*, while moving along the first to third channels 150, 160, and 170.

The water supply frame 130 includes a first inflow hole connected to the first water supply nozzle 50*a*, a second inflow hole connected to the second water supply nozzle 50*b*, and a flow velocity reducer 140 provided on downstream sides of the first inflow hole and the second inflow hole. The flow velocity reducer 140 may have a buffer space 141 buffering the water supplied from the first water supply nozzle 50*a* and the second water supply nozzle 50*b* and may guide the buffered water to the first channel 150 and the second channel 160. Here, the buffer space 141 refers to a temporary storage space where it is connected between the inflow holes 501*a* and 501*b* having different flow rates to adjust differences in a flow velocity.

The cover frame 135 may be installed above the water supply frame 130 and seal the water supply frame 130. The cover frame 135 may be formed integrally with the water supply frame 130 by thermocompression bonding.

Figure 7:
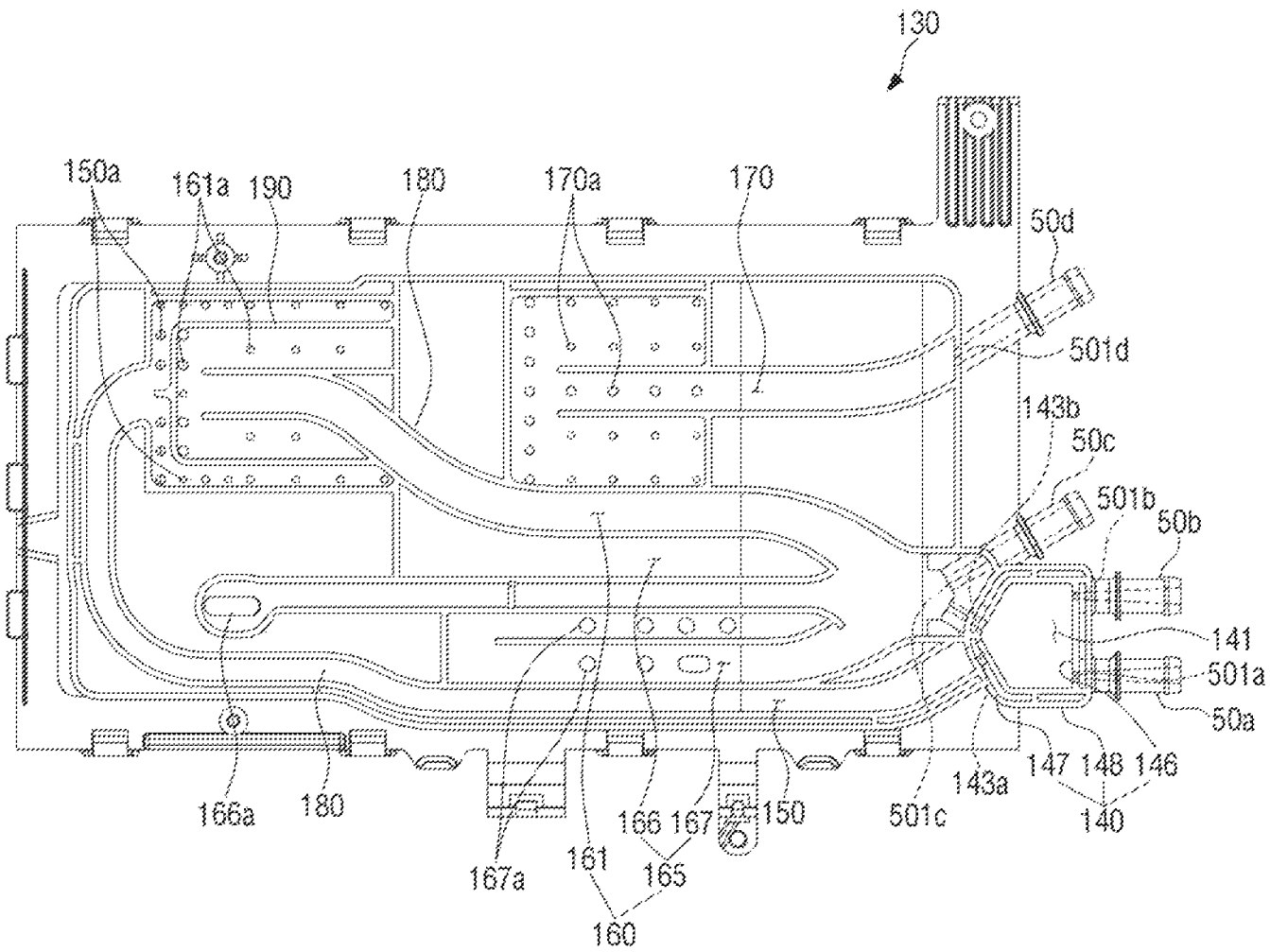
FIG. 7 is a plan view illustrating a water supply frame of a detergent supply device according to an exemplary embodiment of the disclosure.

FIG. 7 is a plan view illustrating a water supply frame of a detergent supply device according to an exemplary embodiment of the disclosure.

Referring to FIG. 7, the flow velocity reducer 140 may be connected between the first inflow hole 501*a* and the second inflow hole 501*b* and the first channel 150 and the second channel 160. As an example, the flow velocity reducer 140 may be disposed to protrude from a rear portion of the water supply frame 130. The flow velocity reducer 140 may also be disposed inside the water supply frame 130 in a state where the flow velocity reducer 140 is connected between the water supply nozzles 50*a* and 50*b* and the channels 150 and 160 to supply the water introduced from the water supply nozzles 50*a* and 50*b* to the channels 150 and 160.

The flow velocity reducer 140 may include a rear plate 146 connected to the first water supply nozzle 51*a* and the second water supply nozzle 50*b*, and a front plate 147 connected to the rear plate 146 and providing the buffer space 141. The flow velocity reducer 140 may further include side plates 148 connecting the front plate 147 and both end portions of the rear plate 146, respectively. A front end portion of the front plate 147 may be formed in a rounded shape and the buffer space 141 may have a cross sectional area decreasing toward a direction in which water is sprayed.

The flow velocity reducer 140 is provided with the first inflow hole 501*a* connected to the first water supply nozzle 50*a* and the second inflow hole 501*b* connected to the second water supply nozzle 50*b*. In addition, the flow velocity reducer 140 is provided with a first discharge hole 143*a* spraying water introduced into the buffer space 141 to the first channel 150 and a second discharge hole 143*b* spraying the water to the second main channel 161.

The sum of cross-sectional areas of the first discharge hole 143*a* and the second discharge hole 143*b* is equal to or greater than that of the first inflow hole 501*a* and the second inflow hole 501*b*. When the sum of cross-sectional areas of the first discharge hole 143*a* and the second discharge hole 143*b* is equal to or greater than that of the first inflow hole 501*a* and the second inflow hole 501*b*, a phenomenon in which a flow rate of water sprayed from the flow velocity reducer 140 is reduced is prevented, such that water may be smoothly supplied to the detergent container 120.

Meanwhile, the cross-sectional area of the first discharge hole 143*a* may be different from that of the second discharge hole 143*b* and the second discharge hole 143*b* may have a cross-sectional area larger than that of the first discharge hole 143*a*. As a result, water with different flow rates may be supplied to each channel. As an example, in a case where it is assumed that a flow rate introduced into the flow velocity reducer 140 through the first water supply nozzle 50*a* and the second water supply nozzle 50*b* is 100, as the cross-sectional areas of the first discharge hole 143*a* and the second discharge hole 143*b* are set so that a flow ratio of the first discharge hole 143*a* to the second discharge hole 143*b* is set to be 40:60, a flow rate thus may be adjusted. In addition to the above described flow rate ratio, water with different flow rates may also be supplied to each channel by changing the cross-sectional area of each of the discharge holes 143*a* and 143*b*.

The third water supply nozzle 50*c* is connected to the second channel 160 and formed with a third discharge hole 501*c* spraying water toward the second lower auxiliary channel 167. The fourth water supply nozzle 50*d* is connected to the third channel 170 and formed with a fourth discharge hole 501*d* spraying water to the third channel 170.

The first water supply nozzle 50*a* and the second water supply nozzle 50*b* may supply water at the same flow rate, and the third water supply nozzle 50*c* and the fourth water supply nozzle 50*d* may also supply water at the same flow rate. Each flow rate of the first water supply nozzle 50*a* and the second water supply nozzle 50*b* may be set larger than that of the third water supply nozzle 50*c*.

The first to third channels 150, 160 and 170 may be formed of a plurality of ribs 180. Each of the ribs 180 may be formed at a gentle slope so that the flow velocity may be maintained, simultaneously with smoothly changing movement directions of water flowing through the first to third channels 150, 160 and 170.

The first channel 150 and the second channel 160 connected to the flow velocity reducer 140 are branched off by the ribs 180. That is, the first channel 150 and the second channel 160 have different flow paths, the water introduced into the flow velocity reducer 140 is stayed in the buffer space 141 so that the flow velocity is reduced by flow rectification, and then the water is sprayed to the first channel 150 and the second channel 160, respectively.

In addition, the water supply frame 130 may further include a first partition wall 190 provided in the first section 131. The first partition wall 190 prevents water flowing through the first channel 150 and the second channel 160 from being mixed.

In a case where water is sprayed by a water supply nozzle of the related art, the sprayed water flows through a channel in a state of having both linearity and rotatability. In this case, the introduced water mixed with air remaining in the channel and air introduced from the other channels by the introduced water causes a cavitation together with a complicated eddy in a form in which the water and the air coexist. Thereby, a noise is generated in the channel.

In a structure of the water supply frame 130 according to an exemplary embodiment of the disclosure, it is possible to stay the water introduced into the flow velocity reducer 140 in the buffer space 141, such that a dynamic pressure component in a high pressure channel may be changed into a constant pressure component. In addition, by allowing the water of which the pressure is changed to a constant pressure to branch off to the first channel 150 and the second channel 160 and to be sprayed, it is possible to reduce a flow rate in the channel in which air mixture may occur.

The first spray holes 150*a* and 161*a* are formed in the first section 131 so that water may be dropped into the main detergent storage 121, and the second spray hole 170*a* is formed in the second section 132 so that water may be dropped into the preliminary detergent storage 122. In addition, the third spray hole 166*a* is formed in the third section 131 so that water may be dropped into the fabric softener storage 123, and the fourth spray hole 167*a* is formed in the fourth section 134 so that water may be dropped into the bleaching agent storage 124.

Additional ribs 180 may be formed in the first to fourth sections 131, 132, 133, and 134 to change the flow paths of the first channel 150 and the second channel 160.

Figure 8:
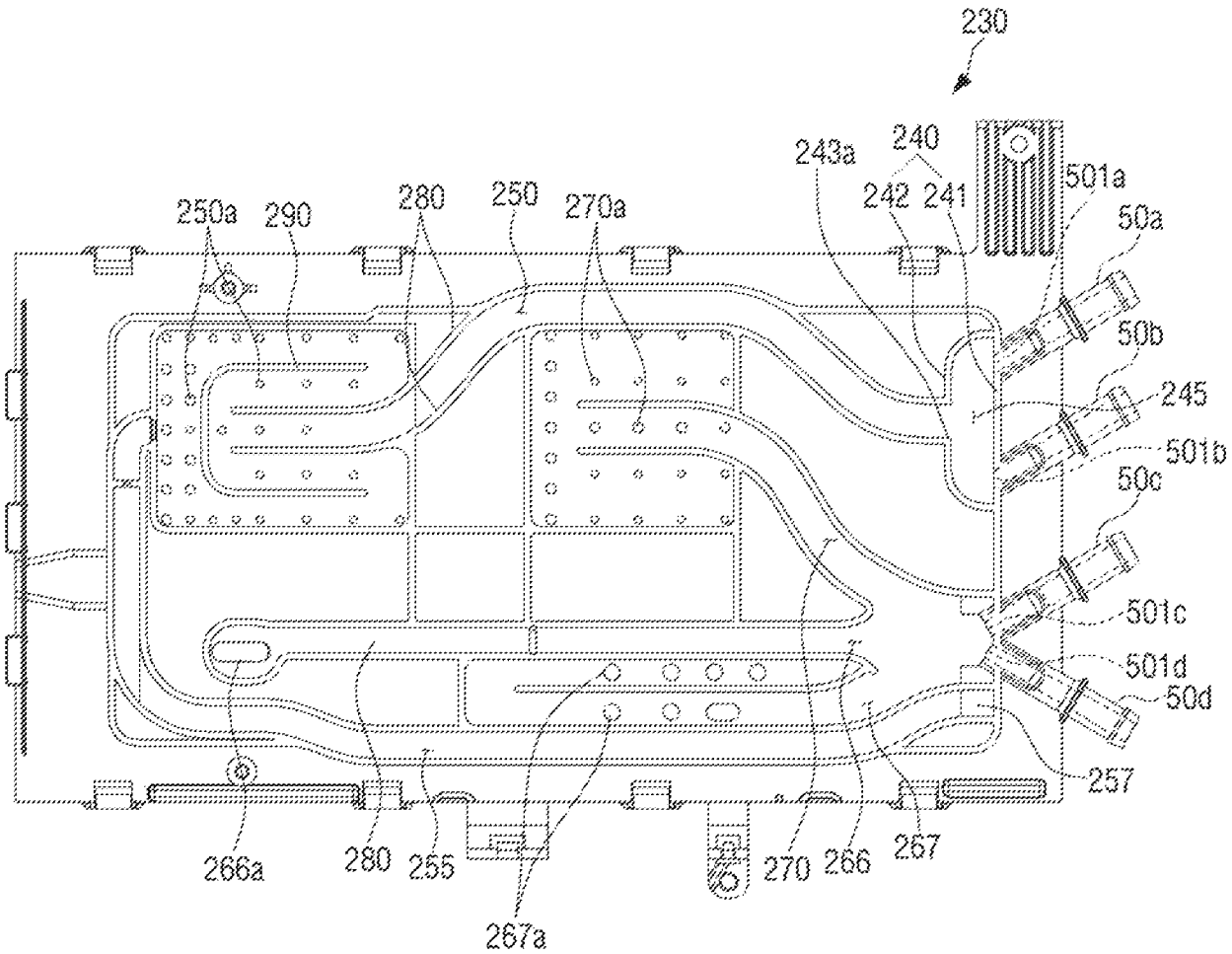
FIG. 8 is a plan view illustrating a water supply frame of a detergent supply device according to another exemplary embodiment of the disclosure.

FIG. 8 is a plan view illustrating a water supply frame of a detergent supply device according to another exemplary embodiment of the disclosure. Hereinafter, differences from those of the detergent supply device 130 according to the exemplary embodiment of the disclosure described in FIGS. 1 to 7 will be mainly described, and omitted descriptions will be replaced with the above described contents.

Referring to FIG. 8, a flow velocity reducer 240 connects a first water supply nozzle 50*a* and a second water supply nozzle 50*b* and a first channel 250. The flow velocity reducer 240 may include a rear plate 241 connected to a first water supply nozzle 51*a* and a second water supply nozzle 50*b* and a front plate 242 connected to the rear plate 241 and providing a buffer space 245. The front plate 242 may be formed in a rounded shape toward the front thereof and a cross sectional area of the buffer space 245 may decrease due to the front plate 242.

The flow velocity reducer 240 is provided with a first inflow hole 501*a* and a second inflow hole 501*b* into which water is introduced from the first water supply nozzle 50*a* and the second water supply nozzle 50*b*, respectively. In addition, the flow velocity reducer 240 is provided with a first discharge hole 243*a* connected to the first channel 250 and spraying the buffered water in the buffer space 245 to the first channel 250. A cross-sectional area of the first discharge hole 243*a* may be equal to or greater than the sum of cross-sectional areas of the first inflow hole 501*a* and the second inflow hole 501*b*.

The first channel 250 is formed to supply water to one side of a first section 131. A water supply frame 230 may further include a bypass channel 255 connected to the other side of the first section 131. The bypass channel 255 is connected to the first section 131 to discharge water guided into the first section 131 to the outside.

The water introduced into the flow velocity reducer 240 is stayed in the buffer space 245, so that the flow velocity is reduced by the flow rectification, and then the water may be guided into the first channel 250. In a case where the flow rate guided into the first section 131 exceeds a predetermined value (in a case where a flow rate dropping from a first spray hole 250*a* is larger than a flow rate supplied from the first channel 250), the water may be discharged to the outside through the bypass channel 255.

A third water supply nozzle 50*c* and a fourth water supply nozzle 50*d* are spaced apart from the second water supply nozzle 50*b*. The third water supply nozzle 50*c* has a third discharge hole 501*c* spraying water toward a fourth channel 267 and the fourth water supply nozzle 50*d* has a fourth discharge hole 501*d* spraying water toward a second channel 270. In a case where water is simultaneously sprayed from the third water supply nozzle 50*c* and fourth water supply nozzle 50*d*, the water may be guided into a third channel 266.

The first water supply nozzle 50*a* and the second water supply nozzle 50*b* may supply water at the same flow rate and the third water supply nozzle 50*c* and the fourth water supply nozzle 50*d* may also supply water at the same flow rate. Each flow rate of the first water supply nozzle 50*a* and the second water supply nozzle 50*b* may be set larger than that of the third water supply nozzle 50*c* and the fourth water supply nozzle 50*d*.

The first to fourth channels 250, 270, 266 and 267 may be formed of a plurality of ribs 280. Each of the ribs 280 may be formed at a gentle slope, such that the flow velocity may be maintained, simultaneously with smoothly changing movement directions of water flowing through the first to fourth channels 250, 270, 266 and 267.

The water introduced into the flow velocity reducer 240 is stayed in the buffer space 245 so that the flow velocity is reduced by flow rectification, and then the water is sprayed only to the first channel 250.

The second to fourth channels 270, 266 and 267 may be branched off by the ribs 280. That is, the second to fourth channels 270, 266 and 267 have different flow paths to guide water sprayed through the third discharge hole 501*c* and the fourth discharge hole 501*d* each formed in the third water supple nozzle 50*c* and the fourth water supple nozzle 50*d* into second to fourth sections 132, 133 and 134.

In addition, the water supply frame 230 may further include a second partition wall 290 provided in the first section 131. The second partition wall 290 may change a flow of the water introduced from the first channel 250 toward the bypass channel 255. As an example, the second partition wall 290 may have a U-shape to change the flow of the water guided from the first channel 250 to the first section 131 at least once into the opposite direction.

Additional ribs 280 may be formed in the first to fourth sections 131, 132, 133 and 134 to change the flow paths of the first to fourth channels 250, 270, 266 and 267.

Figure 10:
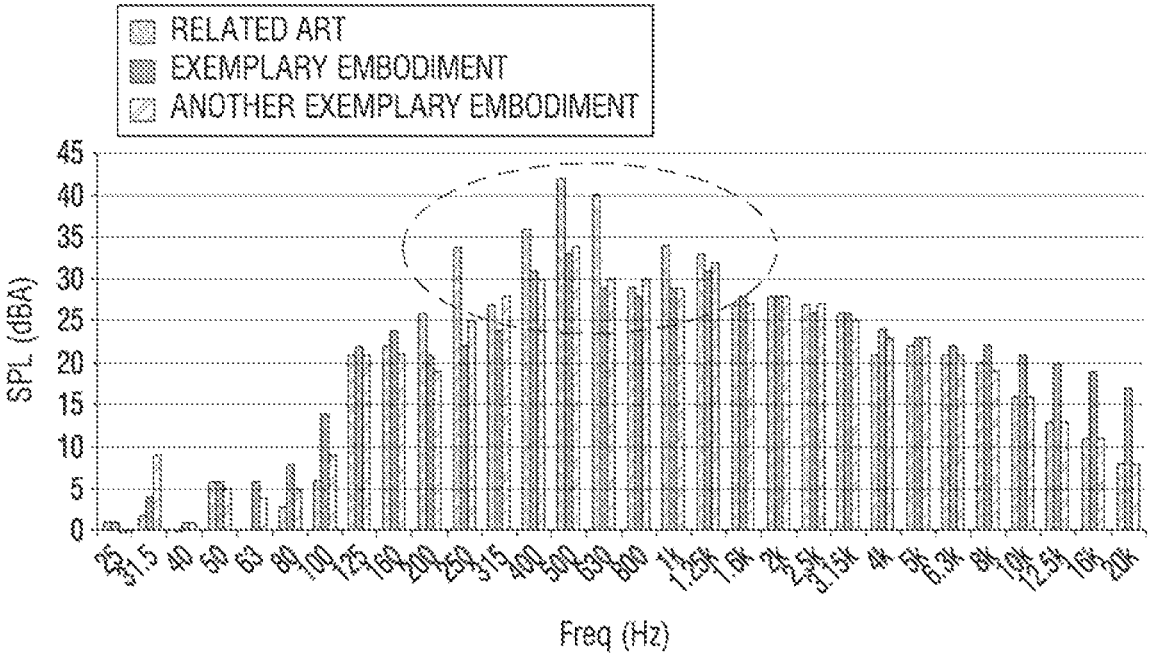
FIGS. 10 and 11 are graphs illustrating the result of a comparison between a noise of a detergent supply device of the related art and a noise of a detergent supply device according to an exemplary embodiment of the disclosure.
Figure 11:
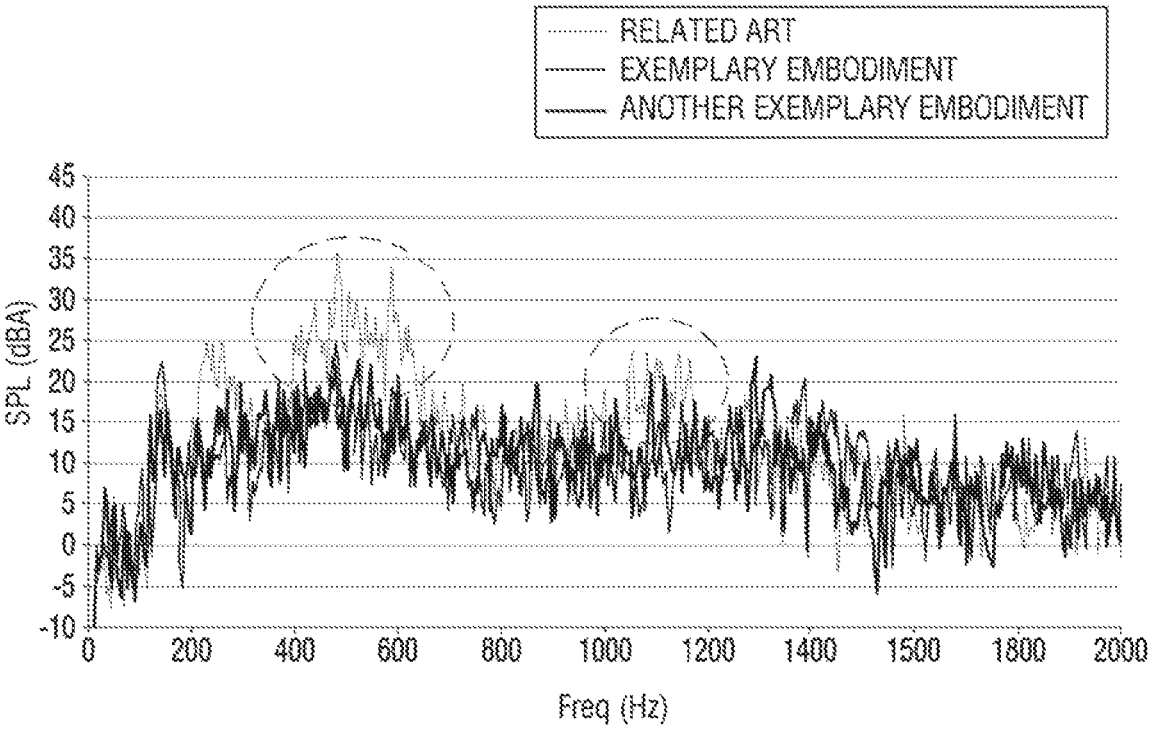

FIG. 9 is a table illustrating the result of a comparison between a noise of a detergent supply device of the related art and a noise of a detergent supply device according to an exemplary embodiment of the disclosure, and FIGS. 10 and 11 are graphs illustrating results of a comparison between a noise of a detergent supply device of the related art and a noise of a detergent supply device according to an exemplary embodiment of the disclosure.

Referring to FIG. 9, as a result of the comparison between sound pressure and loudness of the detergent supply device of the related art and sound pressure and loudness of the detergent supply device according to the exemplary embodiments of the disclosure, it may be appreciated that the detergent supply device of the exemplary embodiments of the disclosure is effective to significantly reduce the sound pressure and loudness.

FIG. 10 is a graph illustrating the result of an octave analysis of noise measurement in the detergent supply device of the related art and the detergent supply device according to the exemplary embodiment of the disclosure. FIG. 11 is a graph illustrating spectra obtained by the noise measurement of the detergent supply device of the related art and the detergent supply device according to the exemplary embodiment of the disclosure.

Referring to FIG. 10 or FIG. 11, in general, a noise due to bubbles generated in the channel is detected in the band of 1 KHz or less, while it may be appreciated that a low frequency cavitation noise of 1 KHz or less is significantly reduced in the detergent supply device according to an exemplary embodiment of the disclosure.

That is, in the detergent supply device according to the exemplary embodiment of the disclosure, a noise generated when water is supplied in a washing machine may be reduced. To this end, by improving a structure of the water supply frame in which bubbles which cause the noise inside the channel may be removed, a flow rate through the channel to which air is inevitably mixed is minimized, the noise may thus be reduced.

An amount of water supplied to each detergent storage may be maintained to be equal to or larger than an existing amount so that an ability of washing detergent of the detergent storage at a low water pressure (for example, 0.5 $kg/cm^2$) is not decrease and an overflow or water leak at a high water pressure (for example, 1.2 $kgf/cm^2$) is not generated.

Although the diverse exemplary embodiments of the disclosure have been individually described hereinabove, the respective exemplary embodiments are not necessarily implemented singly, but may also be implemented so that configurations and operations thereof are combined with those of one or more other exemplary embodiments.

Although the exemplary embodiments of the disclosure have been illustrated and described hereinabove, the disclosure is not limited to the above-mentioned specific exemplary embodiments, but may be variously modified by those skilled in the art to which the disclosure pertains without departing from the scope and spirit of the disclosure as disclosed in the accompanying claims. These modifications should also be understood to fall within the scope of the disclosure.

The invention claimed is:

1. A washing machine comprising:

a main body;

a drum configured to be rotatably disposed in the main body; and a detergent supply device configured to be provided in the main body and supply a detergent into the drum, wherein the detergent supply device includes a housing, a detergent container configured to contain the detergent and be movably coupled to the housing, a water supply frame configured to include an inflow hole into which water supplied from the outside is introduced, a flow velocity reducer provided on a downstream side of the inflow hole and reducing a flow velocity of the water, and first and second water supply nozzles connected to the water supply frame to be supplied with water, wherein the flow velocity reducer comprises:

a rear plate connected to the first water supply nozzle and the second water supply nozzle, a front plate connected to the rear plate and providing a buffer space, and a side plate connecting the front plate and the rear plate to form the buffer space, and wherein a front end portion of the front plate is formed in a rounded shape, and the buffer space has a cross sectional area decreasing toward a direction in which water is sprayed.

2. The washing machine as claimed in claim 1, wherein the water supply frame further includes a channel guiding the water to the detergent container, and the channel includes a first channel and a second channel branched off from the flow velocity reducer.

3. The washing machine as claimed in claim 2, wherein the first channel and the second channel connect to a first section partitioned at a predetermined position of the detergent container.

4. The washing machine as claimed in claim 3, wherein the second channel includes a second main channel connected to the first section, and a second auxiliary channel branched off from the second main channel and supplying water to a second section.

5. The washing machine as claimed in claim 4, wherein the second auxiliary channel includes a second upper auxiliary channel supplying water to the second section, and a second lower auxiliary channel branched off from the second upper auxiliary channel and supplying water to a third section.

6. The washing machine as claimed in claim 5, wherein the water supply frame further includes a third channel spaced apart from the flow velocity reducer and supplying water to a fourth section, and one or more spray holes spraying water to the detergent container are formed in each of the first to fourth sections.

7. The washing machine as claimed in claim 3, wherein the water supply frame further includes a first partition wall provided in the first section and preventing the water guided through the first channel and the second channel from being mixed.

8. The washing machine as claimed in claim 2, wherein the inflow hole has a cross sectional area equal to or smaller than the sum of cross sectional areas of the first channel and the second channel.

9. The washing machine as claimed in claim 2, wherein the channel guides the water to a first section partitioned at a predetermined position of the detergent container, and the water supply frame further includes a bypass channel connected to the first section to discharge the water supplied to the first section to the outside of the water supply frame.

10. The washing machine as claimed in claim 9, wherein the water supply frame further includes a second partition wall provided in the first section and changing a flow of the introduced water from the channel toward the bypass channel.

11. The washing machine as claimed in claim 1, wherein the detergent supply device further includes a cover frame coupled to an upper portion of the water supply frame and sealing the water supply frame.

12. A detergent supply device installed in a washing machine, comprising:

a housing configured to have an opening formed in one side thereof;

a detergent container configured to contain a detergent and be slidably coupled to the housing through the opening; and a water supply frame configured to be coupled to the housing and include a channel guiding water to the detergent container, an inflow hole into which water supplied from the outside is introduced, and a flow velocity reducer provided on a downstream side of the inflow hole and reducing a flow velocity of the water, and first and second water supply nozzles connected to the water supply frame to be supplied with water, and wherein the flow velocity reducer comprises:

a rear plate connected to the first water supply nozzle and the second water supply nozzle, a front plate connected to the rear plate and providing a buffer space, and a side plate connecting the front plate and the rear plate to form the buffer space, and wherein a front end portion of the front plate is formed in a rounded shape, and the buffer space has a cross sectional area decreasing toward a direction in which water is sprayed.

13. The detergent supply device as claimed in claim 12, wherein the channel includes a first channel and a second channel branched off from the flow velocity reducer.

14. The detergent supply device as claimed in claim 12, wherein the channel guides the water to a first section partitioned at a predetermined position of the detergent container, and the water supply frame further includes a bypass channel connected to the first section to discharge the water supplied to the first section to the outside of the water supply frame.

* * * * *